US007592562B1

(12) United States Patent
Vanderwege et al.

(10) Patent No.: US 7,592,562 B1
(45) Date of Patent: Sep. 22, 2009

(54) KNOB ASSEMBLY

(75) Inventors: Michael Vanderwege, Rochester, NY (US); Jose Ricardo Duran, Mendon, NY (US); Scott Bartholomew, Webster, NY (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 12/262,304

(22) Filed: Oct. 31, 2008

(51) Int. Cl.
*H01H 19/00* (2006.01)
*H01H 19/14* (2006.01)
*H01H 21/00* (2006.01)
*H01H 3/08* (2006.01)

(52) U.S. Cl. ..... 200/336; 200/564

(58) Field of Classification Search ..... 200/336
See application file for complete search history.

(56) References Cited

U.S. PATENT DOCUMENTS

| | | | | |
|---|---|---|---|---|
| 2,864,923 | A * | 12/1958 | Mathews | 200/288 |
| 6,067,424 | A * | 5/2000 | Shono | 396/297 |
| 7,223,926 | B1 * | 5/2007 | Gannon et al. | 200/11 R |
| 2008/0289940 | A1 * | 11/2008 | Kim et al. | 200/336 |

* cited by examiner

*Primary Examiner*—Lincoln Donovan
*Assistant Examiner*—Lheiren Mae A Anglo
(74) *Attorney, Agent, or Firm*—Darby & Darby PC; Robert J. Sacco

(57) ABSTRACT

A switch assembly (1) includes a rotary electrical switch body (13) having a plurality of switch positions, a switch stem (12) extending along a first axis (32) and having a first and second ends, the first end engaging the rotary switch (14) for alternating the rotary switch body between the plurality of switch positions responsive to rotation of the switch stem about the first axis, and a knob assembly (10). The knob assembly includes a knob core contacting the second end of the switch stem, a knob collar (22) contacting the knob core and adapted for rotating the knob core and the switch stem about the first axis, where the knob collar includes a first upper stop member (46), and a stop cam (20) having a fixed position relative to the switch stem and disposed between the knob core and the rotary switch, where the stop cam includes a lower stop member (31) having a feature for engaging the first upper stop member when the first upper stop member and the lower stop member are disposed along a common path. In the switch assembly, the first upper stop member travels in a circumferential path normal to the first axis responsive to the knob collar rotating the knob core and the switch stem, where the knob collar is displaceable along the first axis between first and second axial positions, where the lower stop member is in the circumferential path when the knob collar is in the first axial position, and where the lower stop member is removed from the circumferential path when the knob collar is in the second axial position.

20 Claims, 7 Drawing Sheets

KNOB ASSEMBLY

FIELD OF THE INVENTION

The present invention is directed to the field of electric switches, and more particularly to switch assemblies for electrical devices.

BACKGROUND OF THE INVENTION

Many communications devices, such as radios, typically include a rotary switch which is movable to a number of positions. In a rotary switch for a handheld satellite transceiver and other portable communications devices, these positions typically include "off," "channels 1-5" (or more), "scan," "front panel," and, "Z-all" or "reset." Generally, the reset position resets the transceiver by clearing all encryption cipher keys inputted by a user. The front panel position is typically used for allowing the channels and modes of operation to be selected using the key pad on the front panel of the transceiver.

Although the operation of many rotary switch designs is straightforward, many permit the transceiver to be inadvertently turned off by a user turning the rotary switch too far. In such an event, the user must then turn the transceiver back on to resume communication. In some devices, such as satellite transceivers, a reboot period of significant length is required, delaying resumption of communications. Typical switch designs may also permit inadvertent movement of the rotary switch to the reset position. Although some designs of satellite transceivers prevent resetting in the reset position by requiring actuation of a second button, the user may still inadvertently reset the satellite transceiver.

Some satellite transceiver designs have been proposed using "push-to-turn" rotary switches, in which pressure must be applied to the stem of the rotary switch prior switching positions. However, the stem may still be inadvertently pushed and the satellite transceiver may be reset or turned off. Other switch assembly designs have been proposed using "pull-to-turn" rotary switches in which the user must pull on the stem while changing positions. However, such switches typically require additional complexity within the rotary switch, as the pull-to-turn or push-to-turn functionality is typically included within the body of the rotary switch. This also results in switch bodies that are typically larger than those typically used in satellite transceivers, increasing the overall size of the satellite transceiver. In systems where the pull-to-turn or push-to-turn functionality is included in the knob, a groove system is typically used. However, such groove systems can be susceptible to dirt, sand, or grit, resulting in seizing or poor operation of the rotary switch. Therefore, there is a need for an improved device for controlling the operation of rotary switches in communications devices.

SUMMARY OF THE INVENTION

Embodiments of the present invention provide improved knob assemblies for reducing or eliminating switching of a rotary knob to one or more non-preferred states during a mode of operation by requiring a user to exert a force on the knob prior to allowing rotation. In a first embodiment, a switch assembly is provided. The switch assembly includes a rotary electrical switch body comprising a plurality of switch positions, a switch stem extending along a first axis and having a first end and a second end, the first end engaging the rotary switch for alternating the rotary switch body between the plurality of switch positions responsive to rotation of the switch stem about the first axis, and a knob assembly.

In a second embodiment of the present invention, a communications device, is provided and includes a chassis having at least one opening, a rotary electrical switch body disposed within the chassis, the rotary switch body comprising a plurality of switch positions, a switch stem extending through the opening along a first axis, the switch stem having a first end and a second end, the first end disposed within the chassis and engaging the rotary switch for alternating the rotary switch body between the plurality of switch positions responsive to rotation of the switch stem about the first axis, the second end disposed outside the chassis, and a knob assembly.

In the various embodiments of the present invention, the knob assembly includes a knob core contacting the second end of the switch stem, a knob collar contacting the knob core and adapted for rotating the knob core and the switch stem about the first axis, the knob collar comprising at least a first upper stop member, and a stop cam having a fixed position relative to the switch stem and disposed between the knob core and the rotary switch, the stop cam comprising at least one lower stop member having at least one feature for engaging the first upper stop member when the first upper stop member and the lower stop member are disposed along a common path.

In operation, the first upper stop member travels in a circumferential path normal to the first axis responsive to the knob collar rotating the knob core and the switch stem, where the knob collar is displaceable along the first axis between first and second axial positions, where the lower stop member is in the circumferential path when the knob collar is in the first axial position, and where the lower stop member is removed from the circumferential path when the knob collar is in the second axial position.

DETAILED DESCRIPTION

Embodiments of the present invention of the provide improved knob assemblies for reducing or eliminating switching of a rotary knob to one or more non-preferred states during a mode of operation by requiring a user to exert a force on the knob prior to allowing rotation. In particular, the various embodiments of the present invention provide an improved knob assembly, in which the pull-to-turn functionality is incorporated in the knob assembly, for use with a rotary switch. The various embodiments of the present invention also utilize a stop member-based design, as opposed to existing groove-based designs, which are less susceptible to seizing or otherwise malfunction due to dirt, grit or sand.

Therefore, the various embodiments of the present invention provide an upper stop member and stop-based knob assembly that can be used with existing rotary switches. Consequently, the amount of interior space required inside a radio as compared to conventional push- or pull-to-turn switches is reduced, since the functionality is incorporated outside of the radio chassis. This allows existing designs to be manufactured without having to redesign the radio interior. Furthermore, some embodiments of the present invention can be used for retrofitting existing radios in the field with the improved knob assembly without the need to extract the switch from the radio. Although the present invention is described with respect to a rotary switch for a radio, the present invention is not limited in this regard. Embodiments of the present invention can be utilized in any device utilizing rotary switches and where it is undesirable to switch to at least one position inadvertently.

Figure 1:
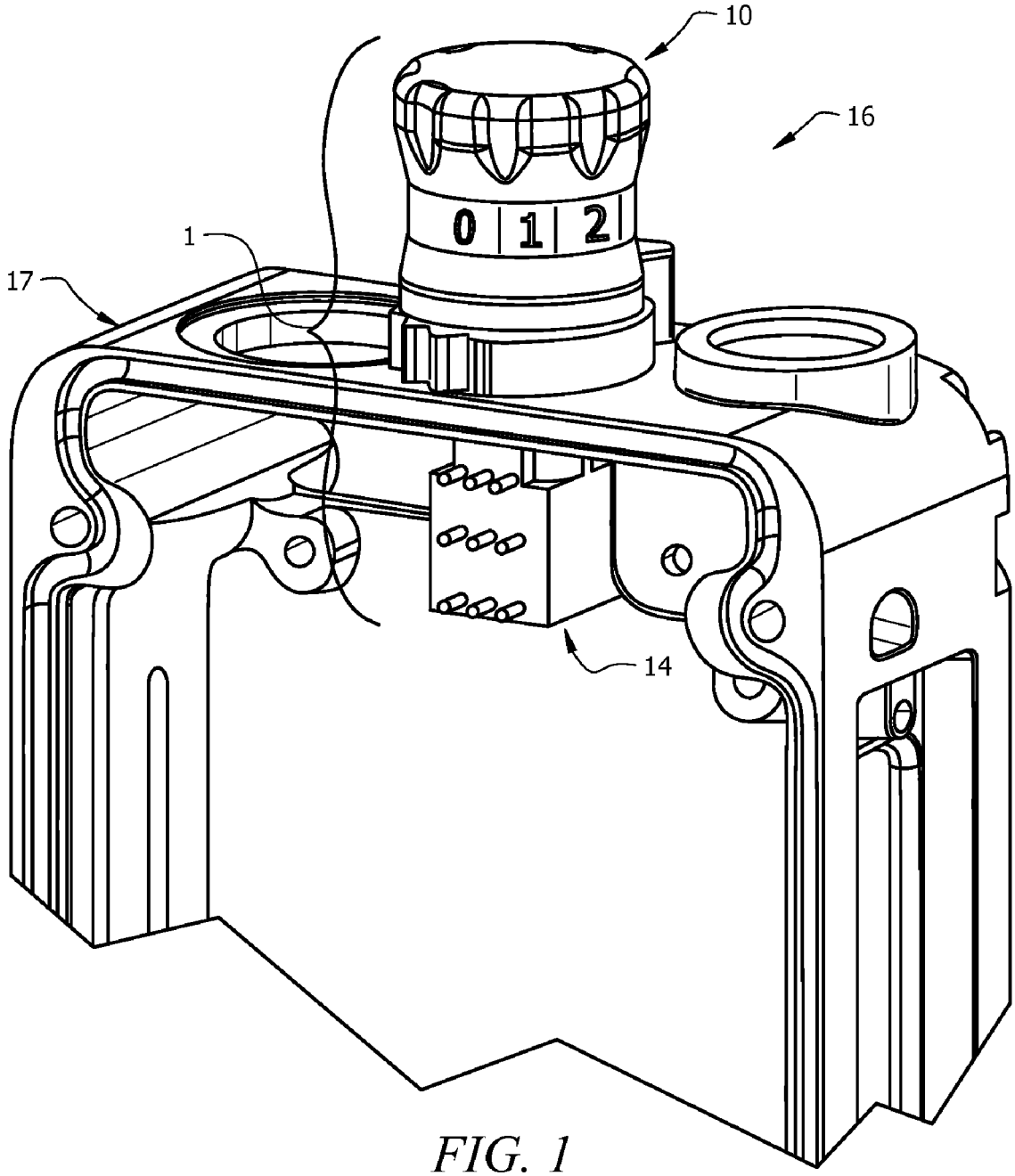
FIG. 1 is a perspective view of a portion of satellite transceiver housing having mounted thereon a switch assembly including a rotary switch and knob assembly according to an embodiment of the present invention.
Figure 2:
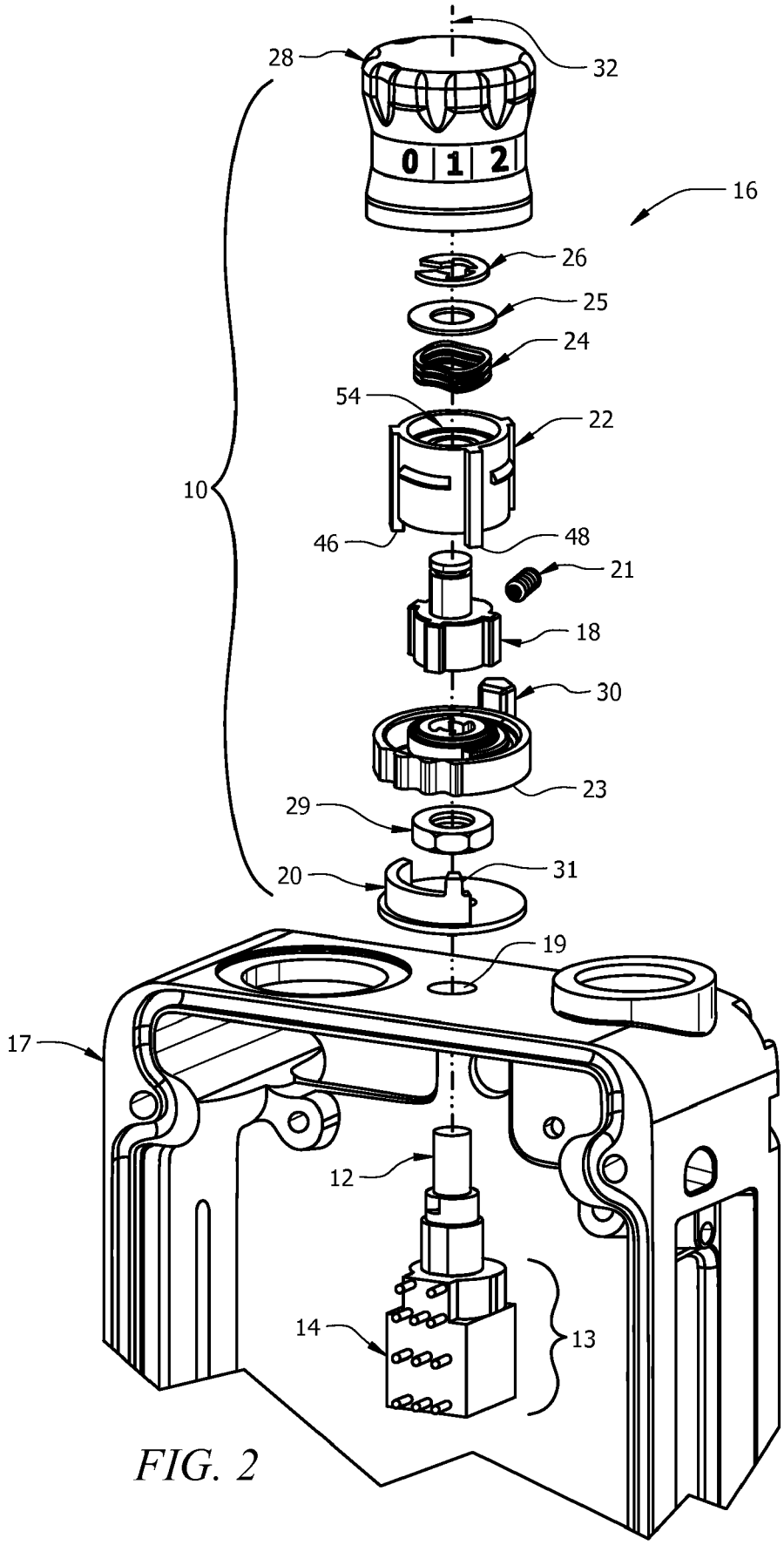
FIG. 2 is an exploded view of the satellite transceiver housing and the knob assembly shown in FIG. 1.

Referring initially to FIGS. 1, 2, 3, 4A, 4B, 5A, and 5B, a switch assembly 1 for a radio 16 according to an embodiment of the present invention is shown. As used herein, a radio 16 can be a receiver, a transmitter, or a transceiver. However, for ease of illustration, the electronic components, other than the switch assembly 1, are not shown. As shown in FIGS. 1 and 2, the radio 16 includes a chassis 17 and a switch assembly 1, where the switch assembly 1 includes a knob assembly 10 and a rotary switch 14. The rotary switch includes a switch body 13 having a plurality of switch positions and a switch stem 12 having a first end engaging with the switch body 13, where the rotation of the switch stem 12 causes the switch body to alternate between different ones of the switch positions. In the case of radio 16, alternating switch positions can place the radio 16 in different modes of operation, a previously described.

A "chassis" as used herein can refer to an enclosure, a frame, a mounting plate, or any other structure or feature for mounting the knob assembly 10 and the rotary switch 14. Only a portion of the chassis 17 of the radio 16 is shown in the FIGS. 1 and 2 for ease of illustration. In the various embodiments of the present invention, the switch body 13 and the knob assembly 10 are mounted on opposing sides of an opening in the chassis 17. Thus, the pull-to-turn functionality is located on the exterior of the radio 16. Such a configuration allows not only repair of the pull-to-turn mechanism without needing access to the interior of chassis 17, but also allows retrofitting of existing rotary switches without needing to remove or replace the existing rotary switch. That is, only replacement of the existing knob assembly is required during repair or retrofit of existing switch assemblies.

In the various embodiments of the present invention, the knob assembly 10 includes a slider component or knob collar 22, a stop cam 20, and a bushing or knob core 18. The knob assembly can also include at least one fastener 21, a mode indicator 23, a compression spring 24, a spring washer, and a retention clip 26, a cap 28. Mode indicator 23 can be formed with a projection 30 which can act as a position indicator in conjunction with markings or features of the cap 28 to denote which mode of operation of the radio 16 is active. In the various embodiments of the present invention, the stop cam 20 is held in a fixed position relative to rotary switch 14. For example, as shown in FIG. 2, the switch stem 12 can extend through an opening 19 of the chassis 17 and through the stop cam 20. The stop cam 20 can then be secured in place by a switch nut 29 holding the stop cam 20 in place against the chassis 17. The mode indicator 23 can then be seated on top of the stop cam 20 and the switch nut 31. The remainder of the knob assembly 10 can then be attached to the extending end of the stem 12.

Figure 3:
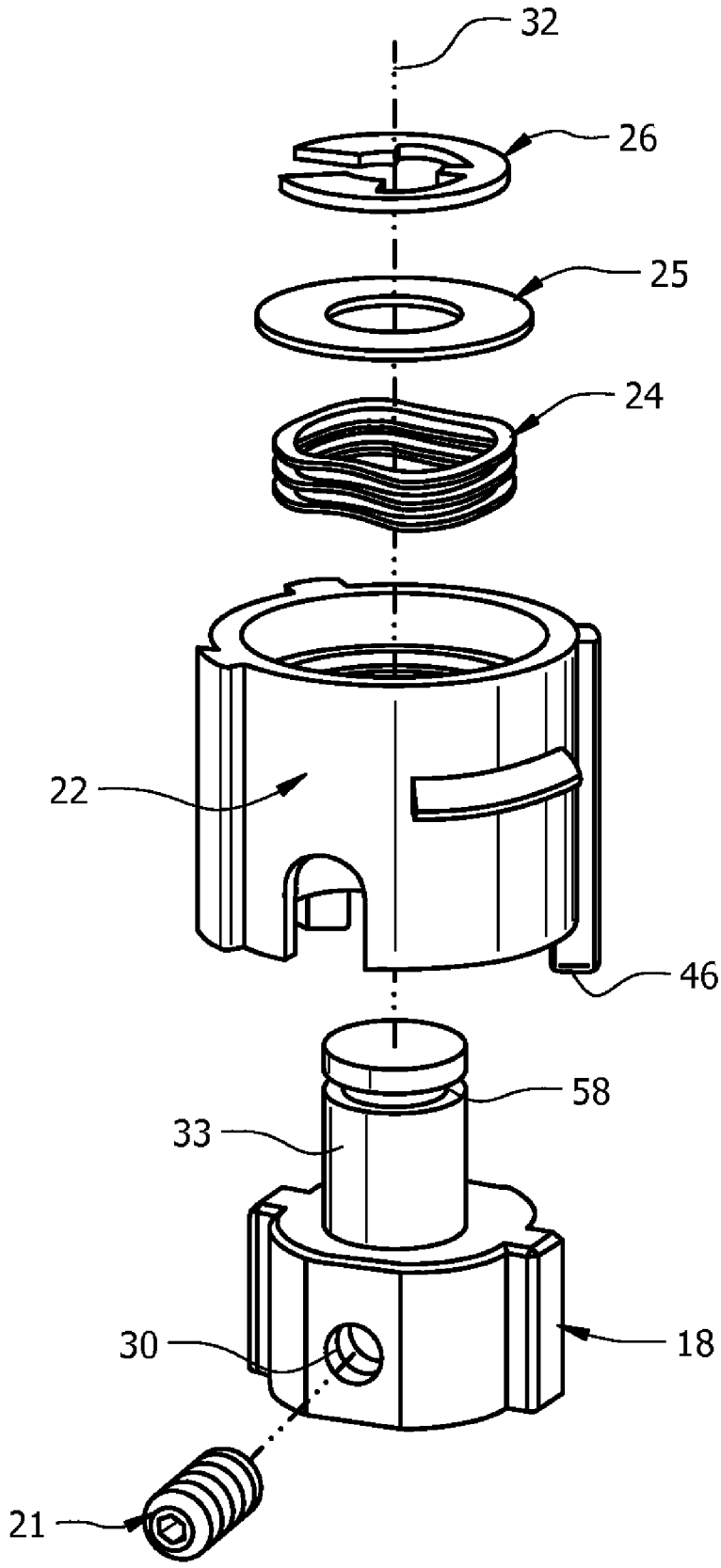
FIG. 3 is an alternate exploded view of a portion of the knob assembly shown in FIG. 1.
Figure 4A:
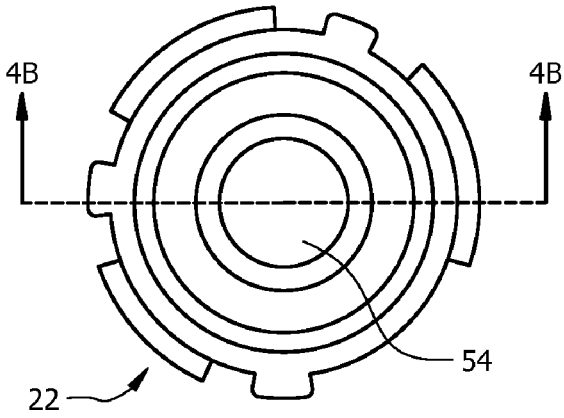
FIG. 4A is a top view of the knob collar of the knob assembly shown in FIG. 1.

The switch stem 12 can be inserted into a stem opening 34 in the knob core 18, thus fixing an axial position of the knob core 18 relative to the switch body 13 and the stop cam 20. That is, a position of the switch body 13, the stop cam 20, and the knob core 18 are fixed with respect to a longitudinal axis 32. The fastener 21 can be used to couple the knob core 18 to the switch stem 12. For example, as shown in the FIG. 3, a fastener slot or hole 30 can be provided for inserting the fastener 21 and securing the knob core 18 to the switch stem 12. In the embodiment in FIG. 3, the fastener hole 30 comprises a threaded hole for accepting a threaded fastener 21. Although a screw-type or threaded fastener is shown in FIGS. 2 and 3, the present invention is not limited in this regard. In the various embodiments of the present invention other types of fasteners and fastening methods can be used. For example, in some embodiments, retention clips or pins can be used. In other embodiments, the knob core 18 can be pressure fit, glued, welded, or otherwise temporarily or permanently fastened to the switch stem 12. In these alternate embodiments, the type, size, and shape of the fastener slot 30 can be adjusted as needed.

Figure 5A:
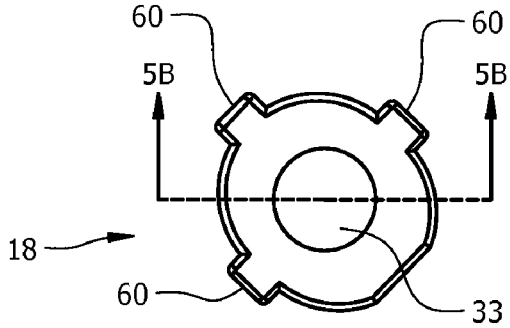
FIG. 5A is a top view of the knob core of the knob assembly shown in FIG. 1.
Figure 4B:
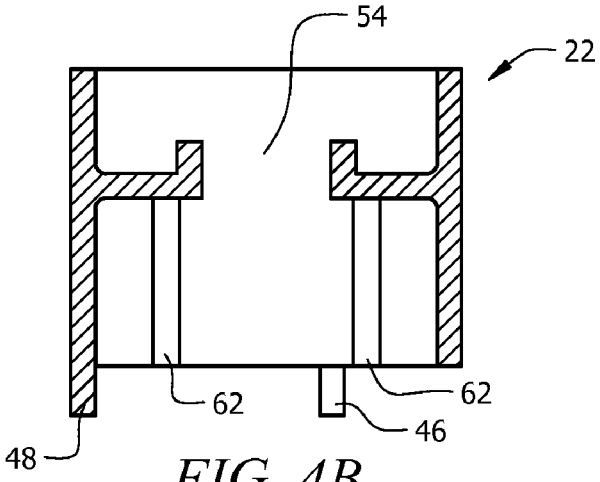
FIG. 4B is a cross section view of the knob collar of the knob assembly shown in FIG. 1.
Figure 5B:
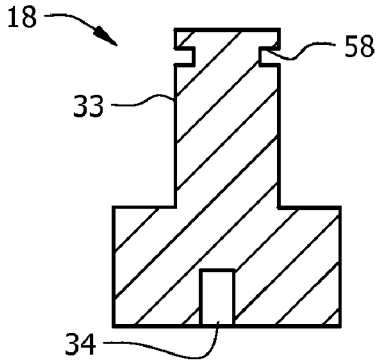
FIG. 5B is a cross section view of the knob core of the knob assembly shown in FIG. 1.
Figure 6A:
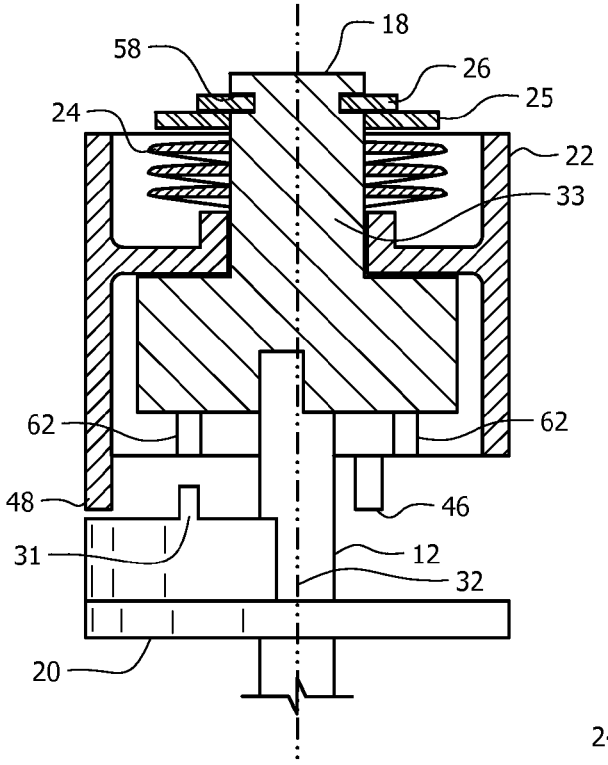
FIG. 6A is a partial cross-section view of a portion of the knob assembly shown in FIG. 1 when force is not exerted on the knob assembly.
Figure 6B:
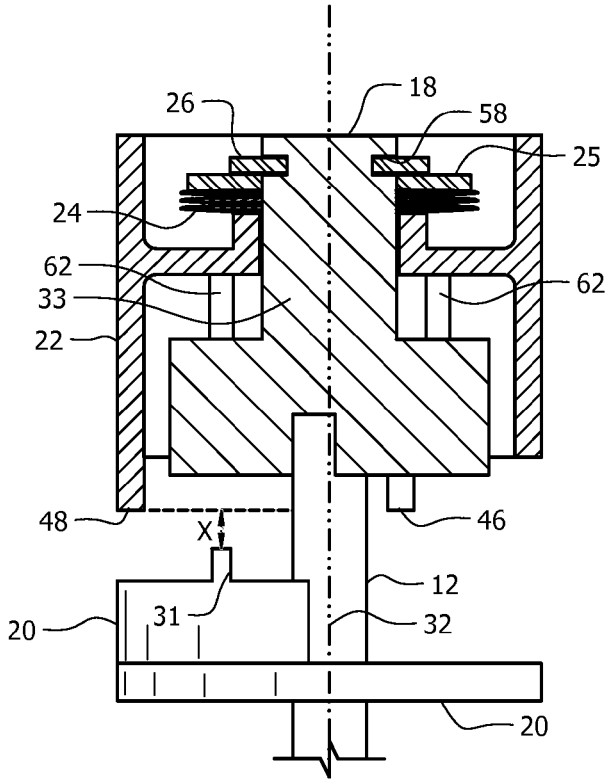
FIG. 6B is a partial cross-section view of a portion of the knob assembly shown in FIG. 1 when force is exerted on the knob assembly.

In the various embodiments of the present invention, the knob core 18 is configured to fit within the knob collar 22, as further shown in FIGS. 6A and 6B. In the various embodiments of the present invention, the knob core 18 and the knob collar 22 include mating features to keep a rotational orientation of the knob core 18 and the knob collar 22 fixed relative to each other. That is, to cause the knob core 18 and the knob collar 22 to rotate together. For example, as shown in FIG. 5A, the knob core 18 can include inner mating features 60, shown as rails. As most clearly shown in FIG. 4B, the knob collar 22 can include matching outer mating features 62, shown as grooves. The combination of grooves and rails also defines an axial displacement allowed for the knob collar 22 relative to the knob core 18, as described below. However, the invention is not limited in this regard and other types and combination of the mating features can be used.

To couple the knob core 18 to the knob collar 22, the knob core 18 can also include a knob stem 33 configured to extend through a bore 54 in the knob collar 22. The knob stem 33 can include a groove or slot 58 for attaching clip 26 to secure the knob core 18 within the knob collar 22. As shown in FIG. 6A, the knob collar 22 can also receive the spring 24 and washer 25, which encircle the knob stem 33 inserted through the bore 54. Thus, after clip 26 is inserted into the slot 58, the clip 26 retains the spring 24 and washer 25 in position within the knob collar 22. Once the clip 26 is inserted, the spring 24 bears against the knob collar 22 and pushes or biases the knob collar 22 towards the stop cam 20, as shown in FIG. 6A. Consequently the knob collar 22 can only be displaced relative to the stop cam 20 by exerting a force on the knob collar 22 to compress spring 24, as shown in FIG. 6B. In the various embodiments of the present invention, stop cam 20, the switch stem 12, the knob stem 33, and the bore 54 are oriented along a same longitudinal axis 32. Therefore any force exerted on the knob collar 22 to compress spring 24 results in an axial displacement of the knob collar 22 along the longitudinal axis in a direction opposite to the force exerted by spring 24.

In the exemplary embodiments in FIGS. 2, 3, 6A, and 6B, spring 24 is shown as comprising a wave or crest-to-crest type spring. However, the present invention is not limited in this regard. In other embodiments of the present invention, the spring 24 can comprise any type of compression spring, including, but not limited to straight compression springs, concave compression springs, conical or spiral compression springs, and barrel compression springs. Furthermore, the spring 24 can have open or closed ends. The ends of the spring can also be ground, squared, or both. In the illustrated embodiment in FIGS. 2, 3, 6A, and 6B, a wave spring is used to reduce the size of the knob assembly 10, as a wave spring provides an higher stiffness than other types of compression springs having similar overall dimensions.

As shown in FIGS. 1-14, the stop cam 20 has a lower stop member 31 and the knob collar has upper stop members 46 and 48. The lower stop member 31 and the upper stop members 46 and 48 are used to control rotation in the knob assembly 10 and to prevent inadvertent repositioning of the rotary switch 14 to an off or reset position. In particular, the lower stop member 31 and the upper stop members 46 and 48 are positioned at a same radius relative to the longitudinal axis 32 when the knob assembly 10 is mounted on the rotary switch 14. Accordingly, then the knob collar 22 rotates, upper stop members 46 and 48 travel along a circumferential path with respect to the longitudinal axis. When the knob collar 22 is biased towards the stop cam 20, the lower stop member 31 also lies in the circumferential path of upper stop members 46 and 48. Consequently, the rotation of the inner and knob collars 18, 22 (and thus the switch stem 12) relative to the stop cam 20 is prevented or limited by features of the lower stop member 31 engaging with features of upper stop member 46 or upper stop member 48. In the exemplary embodiment in FIGS. 1-14, the stop members are configured to have facing surfaces that engage when the inner and knob collars 12, 22 are rotated. However, the present invention is not limited in this regard and other type of features can be provided. For example, the stop members 31, 46, and 48 can include interlocking features or geometries to enhance engagement of the stop members 31, 46, and 48. Additionally, although the lower stop member 31 is shown to extend in a direction opposite to the direction of upper stop members 46 and 48, the invention is not limited in this regard. In the various embodiments of the present invention, the stop members 31, 46, and 48 can extend in the same or different directions as long as lower stop member 31 is in the circumferential path of upper stop members 46 and 48 when the knob collar is in the first axial position and lower stop member 31 is removed from the circumferential path when the knob collar 22 is in the second axial position.

To allow rotation of the inner and knob collars 18, 22 (and thus the switch stem 12) beyond the upper stop member 46 or upper stop member 48, the upper stop members 46 and 48 and the lower stop member 31 can be dimensioned so that compression of the spring 24 provides a spacing X, as shown in FIG. 6B in the direction of longitudinal axis 32. The spacing X removes the lower stop member 31 from the circumferential path of upper stop members 46 and 48 and the inner and knob collars 18, 22 can rotate without the lower stop member 31 engaging either of upper stop members 46 or 48. Although the use of a single lower stop member 31 and two upper stop members 46 and 48 is shown in the exemplary embodiment in FIGS. 1-14, the present invention is not limited in this regard. In the various embodiments of the present invention, any number of upper stop members and stops can be provided, where the position and number of upper stop members and stops is based the type and number of switch positions for the switch body 13.

Referring now to FIGS. 7-14, the operation of the switch assembly is described. Only the stop cam 20 and the knob collar 22 are shown in FIGS. 7-12 for ease of illustration and description. As previously described, the switch stem 12 in FIGS. 1 and 2 can be rotated to one or more selected switch positions to place the radio 16 in different modes of operation. Furthermore, as previously described, the radio 16 can also include one or more switch positions that are not desired during normal operation of the radio. For example, during normal operations, a user will typically not wish to reset the radio 16 or turn off the radio 16 until the end of communications. In some cases, the user can wish to leave the radio 16 operating even if the radio 16 is not actively being used for communications. Accordingly, inadvertent switching to such non-preferred switch positions needs to be prevented or eliminated. Typically, these non-preferred positions are located at far switch positions of the rotary switch 14. That is, at the first or last switch positions of the rotary switch 14. Additionally, a user may also wish to prevent the radio 16 from being inadvertently activated, in which case, the other positions of the rotary switch 14 become non-preferred. In either case, the various embodiments of the present invention prevent or limit the rotary switch 14 from switching to positions generally not preferred by a user.

Figure 7:
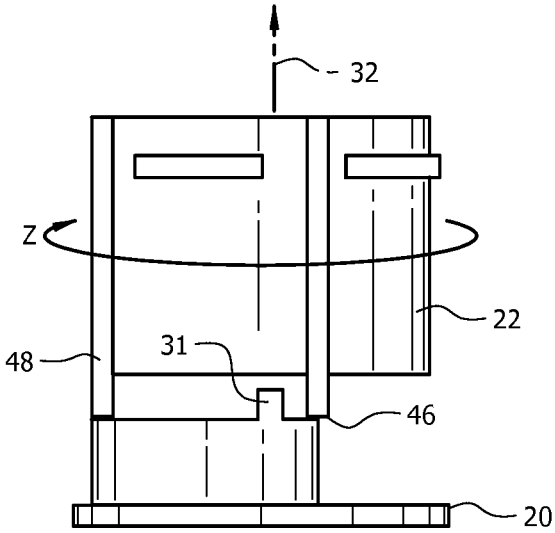
FIG. 7 is a side view of the arrangement of the knob collar and the stop cam in FIG. 1 for an "off" position of the rotary switch in FIG. 1.
Figure 8:
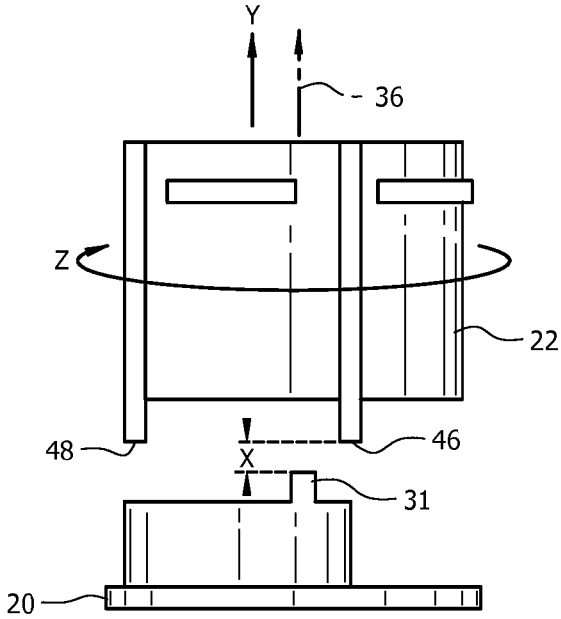
FIG. 8 is a side view of the arrangement of the knob collar and the stop cam in FIG. 1 for an off position of the rotary switch in FIG. 1 after axial displacement of the knob collar according to an embodiment of the present invention.

FIGS. 7 and 8 are side views of the arrangement of the knob collar 22 and the stop cam 20 in FIG. 1 for a first position of the rotary switch 14 in FIG. 1. For ease of illustration and description of FIGS. 7-14, the rotary switch 14 of the radio 16 is assumed to have a first or off position, one or more second or channel positions, and a third or reset position. FIG. 7 shows the arrangement of the knob collar 22 and the stop cam 20 in the off position prior to exerting force on the knob collar 22. As upper stop member 46 and lower stop member 31 are positioned along the same circumferential path, no axial spacing between upper stop member 46 and lower stop member 31 is provided. As previously described with respect to FIG. 6A, rotation of the knob collar 22 in direction Z is prevented by the upper stop member 46 engaging with the lower stop member 31. Therefore, any inadvertent rotation from the off position to one of the channel positions is prevented. Instead, to allow rotation in direction Z, a force can be exerted on knob collar 22 to axially displace knob collar 22 in direction Y, as previously described with respect to FIG. 6B, where Y is parallel to longitudinal axis 32. The force in direction Y overcomes the force exerted by spring 24 to provide the spacing X, as illustrated in FIG. 8, needed for rotating knob collar 22 (as well as knob core 18 and switch stem 12) in the direction Z without upper stop member 46 engaging with lower stop member 31.

Figure 9:
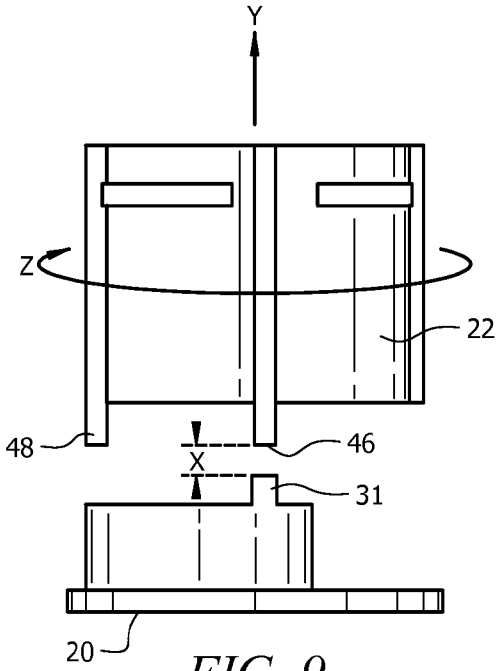
FIG. 9 is a side view of the arrangement of the knob collar and the stop cam in FIG. 1 in between an off position and a first channel position of the rotary switch in FIG. 1 during rotation of the knob collar according to an embodiment of the present invention.
Figure 10:
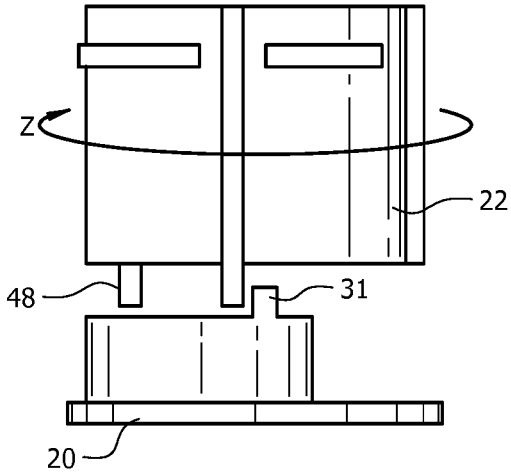
FIG. 10 is a side view of the arrangement of the knob collar and the stop cam in FIG. 1 for the first channel position of the rotary switch in FIG. 1.

In the various embodiments of the present invention, the force in direction Y needs to be maintained until upper stop member 46 clears lower stop member 31. For example, FIG. 9 is a side view of the arrangement of the knob collar and the stop cam in FIG. 1 in between an off position and a first channel position of the rotary switch in FIG. 1 during rotation of the knob collar according to an embodiment of the present invention. As shown in FIG. 9, as knob collar 22 is rotated in direction Z, the force in the Y direction is needed to continue to axial displace knob collar 22 and maintain spacing X. Once upper stop member 46 clears lower stop member 31, the force in the Y direction is not longer needed for further rotation in direction Z. This is illustratively shown in FIG. 10. FIG. 10 is a side view of the arrangement of the knob collar and the stop cam in FIG. 1 for a first channel position of the rotary switch in FIG. 1.

In the various embodiments of the present invention, the rotary switch 14 can include multiple channel or operational positions. Typically switching being channel positions is acceptable to the user and the user may wish to select different channels quickly and easily without having to exert a force other that a rotational force. That is, once the lower stop member 31 is no longer in the path of upper stop member 46, knob collar 22 can be rotated in direction Z without force in the Y direction. However, lower stop member 31 also remains in the path of upper stop member 46 when attempting to rotate in a direction opposite to the Z direction. Therefore, lower stop member 31 also prevents the user from inadvertently switching to the off position without exerting force in the Y direction. Thus to switch to the off position, the steps shown in FIGS. 7-10 can be repeated for rotating in a direction opposite to the Z direction.

Figure 11:
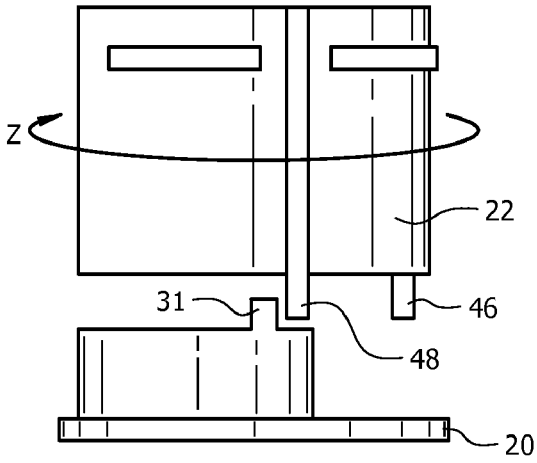
FIG. 11 is a side view of the arrangement of the knob collar and the stop cam in FIG. 1 for a last channel position of the rotary switch in FIG. 1.

In the embodiment of the present invention shown in FIGS. 7-14, the knob collar 22 can be rotated in the Z direction without exerting force in the Y direction until upper stop member 48 engages with lower stop member 31, as shown in FIG. 11. FIG. 11 is a side view of the arrangement of the knob collar and the stop cam in FIG. 1 for a last channel position of the rotary switch in FIG. 1. As shown in FIG. 11, lower stop member 31 also prevents the user from inadvertently switching from the last channel position to the reset position, as previously described in FIGS. 7 and 10. That is, since upper stop member 48 and lower stop member 31 are positioned at the same radius and no spacing between upper stop member 48 and lower stop member 31 is provided, as previously described with respect to FIGS. 6A and 6B, rotation in direction Z is prevented by the upper stop member 48 engaging with the lower stop member 31. Accordingly, a similar procedure, as described above for FIGS. 7-10 is followed for switching from the last channel position to the reset position (and vice versa).

Figure 12:
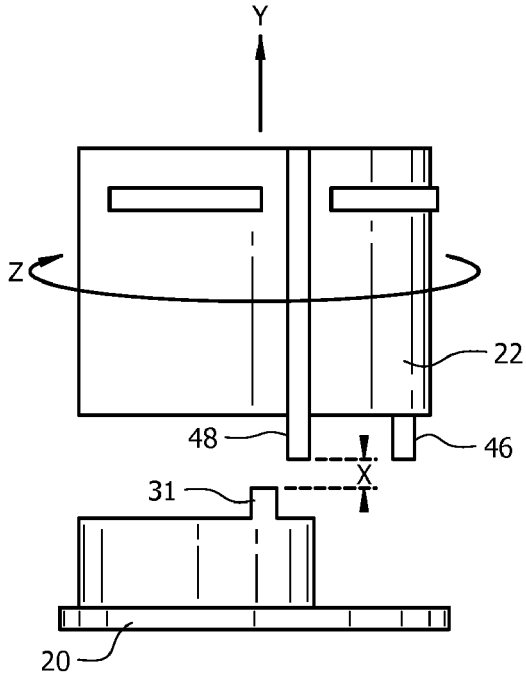
FIG. 12 is a side view of the arrangement of the knob collar and the stop cam in FIG. 1 for the last channel position of the rotary switch in FIG. 1 after axial displacement of the knob collar according to an embodiment of the present invention.
Figure 13:
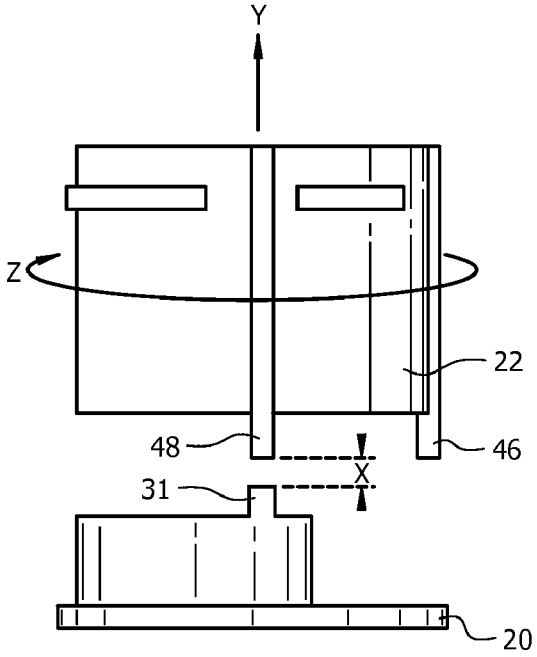
FIG. 13 is a side view of the arrangement of the knob collar and the stop cam in FIG. 1 in between an the last channel position and a reset position of the rotary switch in FIG. 1 during rotation of the knob collar according to an embodiment of the present invention.
Figure 14:
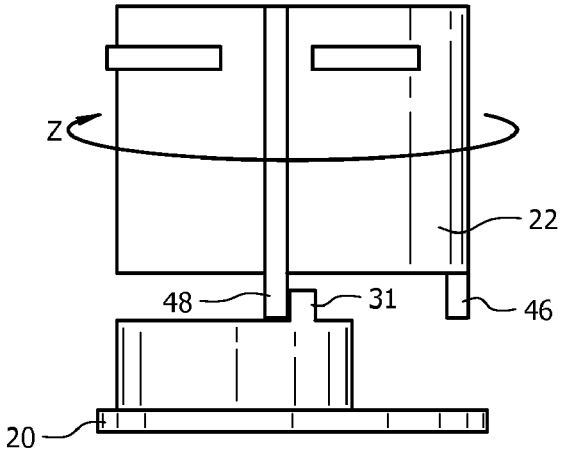
FIG. 14 is a side view of the arrangement of the knob collar and the stop cam in FIG. 1 for the reset position of the rotary switch in FIG. 1.

First, a force is exerted in the Y direction, as shown in FIG. 12. FIG. 12 is a side view of the arrangement of the knob collar 22 and the stop cam 20 in FIG. 1 for the last channel position of the rotary switch 14 in FIG. 1 after axial displacement of the knob collar 22 according to an embodiment of the present invention. As previously described for FIG. 8, sufficient force in direction Y is provided to overcome the force exerted by spring 24 to provide spacing X. Afterwards, as shown in FIG. 13, the knob collar 22 can be rotated while exerting force in the Y direction. FIG. 13 is a side view of the arrangement of the knob collar 22 and the stop cam 20 in FIG. 1 in between an the last channel position and a reset position of the rotary switch 14 in FIG. 1 according to an embodiment of the present invention. As shown in FIG. 13, as long as force is exerted in the Y direction, at least a minimum spacing X is maintained and the knob collar can be rotated in the Z direction without upper stop member 48 engaging with lower stop member 31. Finally, once upper stop member 48 clears lower stop member 31, the force in the Y direction is no longer needed to place the rotary switch 14 in the reset position, as shown in FIG. 14. FIG. 14 is a side view of the arrangement of the knob collar 22 and the stop cam 20 in FIG. 1 for the reset position of the rotary switch 14 in FIG. 1 according to an embodiment of the present invention. As previously described in FIG. 10, lower stop member 31 is now in the path of upper stop member 48 when attempting to rotate in a direction opposite to the Z direction (from a reset position to a channel position). Therefore, lower stop member 31 also prevents the user from inadvertently switching to a channel position without exerting force in the Y direction. Thus to switch from the reset position, the steps in FIGS. 11-14 can be repeated for rotating in a direction opposite to the Z direction.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A switch assembly, comprising:

a rotary electrical switch body comprising a plurality of switch positions, a switch stem extending along a first axis and having a first end and a second end, said first end engaging a rotary switch for alternating said rotary electrical switch body between said plurality of switch positions responsive to rotation of said switch stem about said first axis; and a knob assembly, said knob assembly comprising:

a knob core contacting said second end of said switch stem, a knob collar contacting said knob core and adapted for rotating said knob core and said switch stem about said first axis, said knob collar comprising at least a first upper stop member, and a stop cam having a fixed position relative to said switch stem and disposed between said knob core and said rotary switch, said stop cam comprising at least one lower stop member having at least one feature for engaging said first upper stop member when said first upper stop member and said lower stop member are disposed along a common path, wherein said first upper stop member travels in a circumferential path normal to said first axis responsive to said knob collar rotating said knob core and said switch stem, wherein said knob collar is displaceable along said first axis between first and second axial positions, wherein said lower stop member is in said circumferential path when said knob collar is in said first axial position, and wherein said lower stop member is removed from said circumferential path when said knob collar is in said second axial position.

2. The assembly of claim 1, wherein said knob assembly further comprises a biasing element for mechanically coupling said knob core and said knob collar, wherein said biasing element is operable to displace said knob collar portion from said second axial position to said first axial position.

3. The assembly of claim 2, wherein said biasing element comprises a spring.

4. The assembly of claim 3, wherein said spring comprises a wave spring.

5. The assembly of claim 1, wherein said switch stem is rotatable between said plurality of switch positions when said knob collar is in said second axial position.

6. The assembly of claim 5, wherein said plurality of switch positions comprises at least a first switch position and at least a second switch position, wherein said first upper stop member and said lower stop member are arranged to prevent said knob collar from rotating said knob core and said switch stem between said first switch position and said second switch position when said knob collar is in said first position.

7. The assembly of claim 6, wherein said knob collar further comprises at least a second upper stop member, said plurality of switch positions further comprise at least a third position, and said second upper stop member and said lower stop member are arranged to prevent said knob collar from rotating said knob core and said switch stem between said second switch position and said third switch position when said knob collar is in said first axial position.

8. The assembly of claim 6, wherein said second switch position comprises a plurality of second switch positions, and wherein said knob collar is free to rotate said knob core and said switch stem among said plurality of second switch positions when said knob collar is in said first axial position.

9. The assembly of claim 1, wherein said first upper stop member and said lower stop member are arranged to prevent said knob collar from rotating said knob core and said switch stem between said first switch position and said second switch position when said knob collar is in said first position.

10. A communications device, comprising:

a chassis having at least one opening;

a rotary electrical switch body disposed within said chassis, said rotary electrical switch body comprising a plurality of switch positions, a switch stem extending through said opening along a first axis, said switch stem having a first end and a second end, said first end disposed within said chassis and engaging a rotary switch for alternating said rotary electrical switch body between said plurality of switch positions responsive to rotation of said switch stem about said first axis, said second end disposed outside said chassis; and a knob assembly, said knob assembly comprising:

a knob core contacting said second end of said switch stem, a knob collar contacting said knob core and adapted for rotating said knob core and said switch stem about said first axis, said knob collar comprising at least a first upper stop member, and a stop cam having a fixed position relative to said switch stem and disposed between said knob core and said rotary switch, said stop cam comprising at least one lower stop member having at least one feature for engaging said first upper stop member when said first upper stop member and said lower stop member are disposed along a common path, wherein said first upper stop member travels in a circumferential path normal to said first axis responsive to said knob collar rotating said knob core and said switch stem, wherein said knob collar is displaceable along said first axis between first and second axial positions, wherein said lower stop member is in said circumferential path when said knob collar is in said first axial position, and wherein said lower stop member is removed from said circumferential path when said knob collar is in said second axial position.

11. The communications device of claim 10, wherein said knob assembly further comprises a biasing element for mechanically coupling said knob core and said knob collar, wherein said biasing element is operable to displace said knob collar portion from said second axial position to said first axial position.

12. The communications device of claim 11, wherein said biasing element comprises a spring.

13. The communications device of claim 12, wherein said spring comprises a wave spring.

14. The assembly of claim 10, wherein said switch stem is rotatable between said plurality of switch positions when said knob collar is in said second axial position.

15. The assembly of claim 14, wherein said plurality of switch positions comprises at least a first switch position and at least a second switch position, and said first upper stop member and said lower stop member are arranged to prevent said knob collar from rotating said knob core and said switch stem between said first switch position and said second switch position when said knob collar is in said first position.

16. The assembly of claim 14, wherein said knob collar further comprises at least a second upper stop member, said plurality of switch positions further comprise at least a third position, and said second upper stop member and said lower stop member are arranged to prevent said knob collar from rotating said knob core and said switch stem between said second switch position and said third switch position when said knob collar is in said first axial position.

17. The assembly of claim 14, wherein said second switch position comprises a plurality of second switch positions, and wherein said knob collar is free to rotate said knob core and said switch stem among said plurality of second switch positions when said knob collar is in said first axial position.

18. The assembly of claim 14, wherein said second upper stop member and said lower stop member are arranged to prevent said knob collar from rotating said knob core and said switch stem between said second switch position and said third switch position when said knob collar is in said first axial position.

19. A switch assembly, comprising:

a rotary electrical switch body comprising at least first, second, and third switch positions, a switch stem extending along a first axis and having a first end and a second end, said first end engaging a rotary switch for alternating said rotary electrical switch body between said plurality of switch positions responsive to rotation of said switch stem about said first axis; and a knob assembly, said knob assembly comprising:

a knob core contacting said second end of said switch stem and having a fixed position relative to said switch stem, a knob collar contacting said knob core and adapted for rotating said knob core and said switch stem about said first axis, said knob collar comprising at least first and second upper stop members, and a stop cam having a fixed position relative to said switch stem and disposed between said knob core and said rotary switch, said stop cam comprising at least one lower stop member having at least one feature for engaging said first upper stop member when said first upper stop member and said lower stop member are disposed along a common path, wherein said first and said second upper stop members travel in a circumferential path normal to said first axis responsive to said knob collar rotating said knob core and said switch stem, wherein said knob collar is displaceable along said first axis between first and second axial positions, wherein said lower stop member is in said circumferential path when said knob collar is in said first axial position, and wherein said lower stop member is removed from said circumferential path when said knob collar is in said second axial position.

20. The assembly of claim 19, wherein said knob assembly further comprises a biasing element for mechanically coupling said knob core and said knob collar, wherein said biasing element is operable to displace said knob collar portion from said second axial position to said first axial position.

* * * * *